US008777377B2

(12) United States Patent
Nagata et al.

(10) Patent No.: US 8,777,377 B2
(45) Date of Patent: Jul. 15, 2014

(54) LIQUID DISCHARGE HEAD

(75) Inventors: Rumi Nagata, Tokyo (JP); Hiromasa Amma, Kawasaki (JP); Keisuke Iinuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/538,313

(22) Filed: Jun. 29, 2012

(65) Prior Publication Data

US 2013/0010034 A1 Jan. 10, 2013

(30) Foreign Application Priority Data

Jul. 4, 2011 (JP) ..... 2011-148187

(51) Int. Cl.
*B41J 2/05* (2006.01)
*B41J 2/14* (2006.01)

(52) U.S. Cl.
USPC ..... 347/58; 347/50

(58) Field of Classification Search
None
See application file for complete search history.

(56) References Cited

U.S. PATENT DOCUMENTS 6,834,937 B2 * 12/2004 Spivey et al. ..... 347/50
7,240,991 B2 7/2007 Timm
2008/0246810 A1 * 10/2008 Shimamura ..... 347/50

* cited by examiner

*Primary Examiner* — Geoffrey Mruk
(74) *Attorney, Agent, or Firm* — Canon USA Inc IP Division

(57) ABSTRACT

A liquid discharge head includes a recording element substrate including an electrode pad, a support member including a recess that supports the recording element substrate on a bottom surface thereof, an electric wiring member, and a sealant. The electric wiring member includes an opening through which the recording element substrate is exposed, an electric lead wire extending from the opening and connected to the electrode pad, and a protrusion formed in the opening and extending between a side surface of the recording element substrate and an inner side surface of the recess facing the side surface. A distal end of the protrusion is in contact with the bottom surface of the recess. The sealant is disposed in a region surrounded by a surface of the protrusion, the bottom surface of the recess, the inner side surface of the recess, and the side surface of the recording element substrate.

11 Claims, 8 Drawing Sheets

LIQUID DISCHARGE HEAD

BACKGROUND OF THE INVENTION

1. Field of the Invention

The present invention relates to a liquid discharge head that discharges ink toward a recording medium such as recording paper and a method of making the liquid discharge head.

2. Description of the Related Art

A liquid discharge head includes a recording element substrate, a flexible wiring substrate, and a support member. Electrothermal transducers, ink chambers, and other components are disposed in the recording element substrate. The flexible wiring substrate electrically connects the recording element substrate to a recording apparatus body. The support member supports the recording element substrate and the flexible wiring substrate. In general, the recording element substrate and the flexible wiring substrate are affixed to and supported by the support member. Electrode lead wires, which extend from the flexible wiring substrate, are superposed on and joined to electrode pads of the recording element substrate. The electrode lead wires, the electrode pads, and the joints therebetween are sealed with a sealant.

In an existing technology, the front side of the electrode lead wires and the back side of the electrode lead wires are sealed with different sealants. To be specific, the recording element substrate is disposed in a recess of the support member, and a gap between an inner surface of the recess and a side surface of the recording element substrate is filled with a first sealant. The first sealant has a comparatively high fluidity and can flow into a small gap on the back side of the electrode lead wires, while the first sealant has elasticity when cured. The back side of the electrode lead wire is sealed with the first sealant having such characteristics. Moreover, a second sealant is applied to the front side of the electrode lead wires including the joints between the electrode lead wires are the electrode pads. The second sealant has high adhesion strength and hardness when cured and is capable of maintaining the shape with which the sealant was applied. The second sealant protects the electrode lead wires, the electrode pads, and the joints against an external force that is exerted on these portions due to wiping or the like. In the description below, the electrode lead wires, the electrode pads, and the joints may be collectively referred to as an "electrical connection portion".

It is desirable that a sealant is not in contact with the outer periphery of the recording element substrate excluding the electrical connection portion. In other words, it is desirable that the sealant be applied to only a predetermined region of the outer periphery of the recording element substrate. This is because, an unwanted external force may act on the recording element substrate when the sealant expands and contracts due to change in the environment. In particular, if the size of the recording element substrate is reduced in order to reduce the size of the liquid discharge head, it becomes more likely that the recording element substrate become deformed by such an external force, and thereby ink discharge error may occur or the landing accuracy of ink droplets may decrease.

If a sealant having a high fluidity, such as the aforementioned first sealant, is used to seal the electrical connection portion, the sealant may flow out of the predetermined region. On the other hand, if a sealant having a high viscosity, such as the aforementioned second sealant, is used to seal the electrical connection portion, the electrical connection portion may not be completely covered by the sealant.

U.S. Pat. No. 7,240,991 describes a method of forming a barrier of an adhesive to prevent a sealant having a high fluidity from flowing out of a predetermined region. To be specific, a barrier is formed between a region of the outer periphery of a recording element substrate in which an electrical connection portion is formed and the remaining region so as to separate the region from the remaining region. After forming the barrier, the sealant is applied.

With the technology described in U.S. Pat. No. 7,240,991, the number of used materials increases because the barrier is formed from an adhesive that is different from the sealant. Moreover, because the steps of applying the adhesive and curing the adhesive are necessary, the number of production steps increase and thereby the production cost may increase.

SUMMARY OF THE INVENTION

According to a first aspect of the present invention, a liquid discharge head includes a recording element substrate including an electrode pad for sending a signal to an element that generates energy used to discharge liquid; a support member including a recess that supports the recording element substrate on a bottom surface thereof; an electric wiring member joined to a surface of the support member in which the recess is formed, the electric wiring member including an opening through which the recording element substrate is exposed, an electric lead wire extending from the opening and connected to the electrode pad, and a protrusion formed in the opening and extending between a side surface of the recording element substrate and an inner side surface of the recess facing the side surface, a distal end of the protrusion contacting the bottom surface of the recess; and a sealant disposed in a region surrounded by a surface of the protrusion, the bottom surface of the recess, the inner side surface of the recess, and the side surface of the recording element substrate.

According to a second aspect of the present invention, a method of making a liquid discharge head includes preparing a recording element substrate, a support member, and an electric wiring member, the recording element substrate including an electrode pad for sending a signal to an element that generates energy used to discharge liquid, the support member including a recess for supporting the recording element substrate on a bottom surface thereof, the electric wiring member including an electric lead wire to be connected to the electrode pad and an opening through which the recording element substrate is exposed; joining the electrode pad disposed along a side of the recording element substrate to the electrode lead wire extending from an edge of the opening of the electric wiring member; bending a protrusion formed in the opening and extending between a side surface of the recording element substrate and an inner side surface of the recess facing the side surface so a distal end of the protrusion contacts the bottom surface of the protrusion; and applying a sealant into a region surrounded by a surface of the protrusion, the bottom surface of the recess, the inner side surface of the recess, and the side surface of the recording element substrate so a joint between the electrode pad and the electrode lead wire is covered by the sealant.

Further features will become apparent from the following description of exemplary embodiments with reference to the attached drawings.

DESCRIPTION OF THE EMBODIMENTS

First Embodiment

A first embodiment of the present invention will be described with reference to the drawings. Here, an ink tank and a liquid discharge head are integrated with each other. However, the ink tank may be detachable from the liquid discharge head.

Figure 1A:
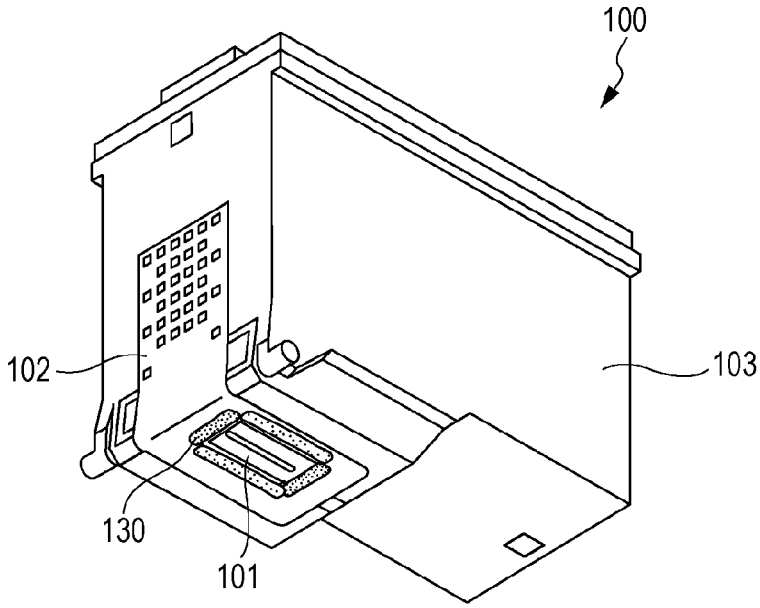
FIG. 1A is a perspective view of a liquid discharge head cartridge according to a first embodiment.
Figure 1B:
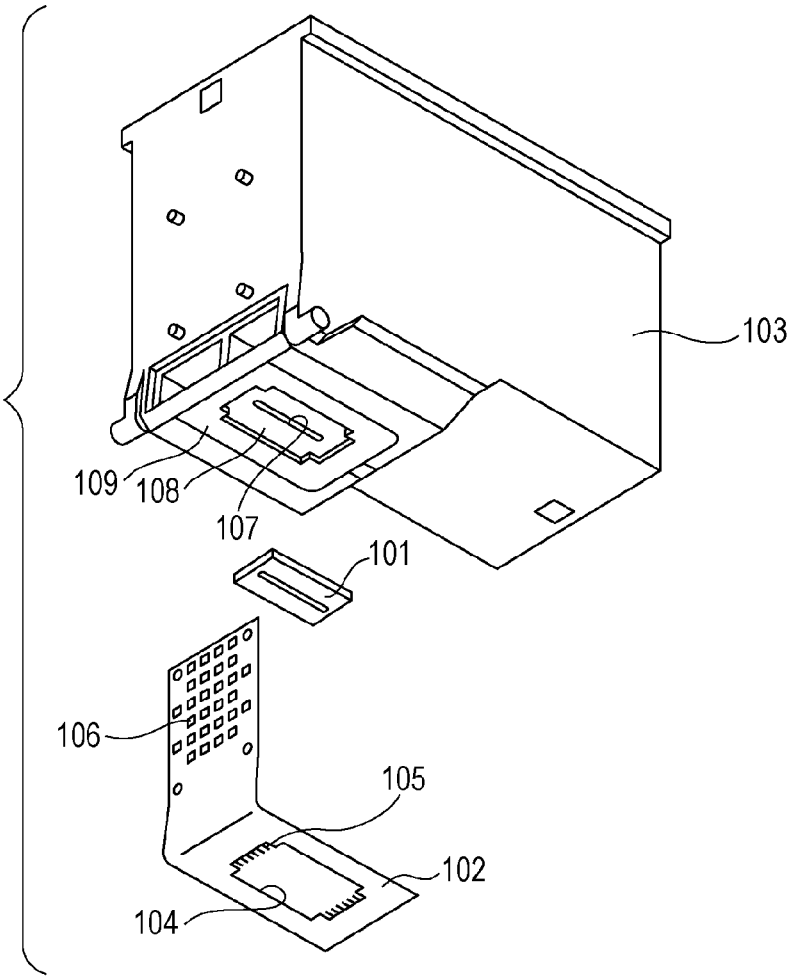
FIG. 1B is an exploded perspective view of the liquid discharge head.

FIG. 1A is a perspective view of a liquid discharge head cartridge 100 as disclosed herein. FIG. 1B is an exploded perspective view of a liquid discharge head portion of the liquid discharge head cartridge 100. In the following description, the liquid discharge head cartridge may be referred to as a "head cartridge".

Figure 2A:
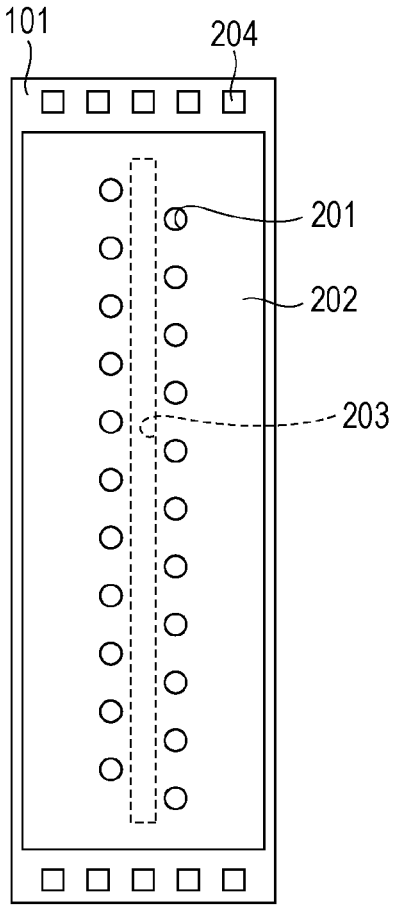
FIG. 2A is a plan view of the front side of a recording element substrate according to the first embodiment.
Figure 2B:
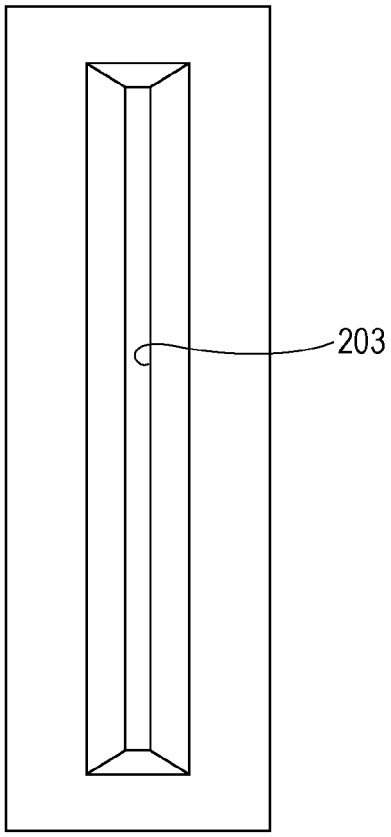
FIG. 2B is a plan view of the back side of the recording element substrate.

FIG. 2A is a plan view of the front side of a recording element substrate 101 of the liquid discharge head portion, and FIG. 2B is a plan view of the back side of the recording element substrate 101.

As illustrated in FIGS. 2A and 2B, the recording element substrate 101 is a substantially rectangular plate-shaped member made from a silicon (Si) material and having a thickness of 0.625 mm. Electrothermal transducers (not shown) are arranged on the front side of the recording element substrate 101. The electrothermal transducers generate energy for discharging ink. Electrode pads 204 are arranged on the front side of the recording element substrate 101 along at least one of the sides (in the first embodiment, along two opposite short sides) of the recording element substrate 101. Wiring lines (not shown) made from aluminium (Al) are disposed on the front side of the recording element substrate 101. The wiring lines electrically connect the electrode pads 204 to the electrothermal transducers so that electric power is supplied to the electrothermal transducers. The electrothermal transducers, the electrode pads 204, and the wiring lines are formed by film deposition. In the first embodiment, heaters are used as the electrothermal transducers.

A flow passage forming member 202 is formed on the front side of the recording element substrate 101 by photolithography. Ink discharge ports 201 and ink flow passages (not shown) are formed in the flow passage forming member 202 so as to correspond to the electrothermal transducers. A common liquid supply port 203 for supplying ink to the ink flow passages is formed in the recording element substrate 101. The liquid supply port 203 extends through the recording element substrate 101 and has an opening extending in the longitudinal direction of the recording element substrate 101.

An electric wiring member 102 includes an opening 104 (device hole), which has a substantially rectangular shape, and electrode lead wires 105. The recording element substrate 101 is disposed in the opening 104. The electrode lead wires 105 are connected to the electrode pads 204, which are disposed on the recording element substrate 101. The electrode lead wires 105 extend toward the inside of the opening 104 from sides (edges) of the opening 104. To be specific, the electrode lead wires 105 extend toward the inside of the opening 104 from two shorts sides of the opening 104 facing two short sides of the recording element substrate 101 along which the electrode pads 204 are arranged.

The electric wiring member 102 further includes external signal input terminals 106, to which a drive control signal is input from the recording apparatus body (not shown). The external signal input terminals 106 and the electrode lead wires 105 are connected to each other through copper foil conductors in the electric wiring member 102, which has flexibility. The electric wiring member 102 is, for example, a tape automated bonding (TAB) tape.

Each of the electrode lead wires 105 of the electric wiring member 102 is joined to a corresponding one of the electrode pads 204 of the recording element substrate 101. Joints between the electrode lead wires 105 and the electrode pads 204 are covered with a sealant 130, which protects the joints from an external force and a liquid such as ink.

A support member 103 is a part of a housing portion of the liquid discharge head and is made by molding a resin material. In the first embodiment, the resin material is modified polyphenylene ether. A glass filler in the amount of 35 mass % is added to the resin material to increase the rigidity of the support member 103. An ink supply channel 107, through which ink is supplied from an ink storage portion, is formed in the support member 103. The recording element substrate 101 is bonded to the support member 103 using a thermosetting adhesive. When bonding the recording element substrate 101 to the support member 103, for example, the thermosetting adhesive is applied to a predetermined position on the support member 103, and then the recording element substrate 101 is placed on the support member 103 at the predetermined position. The electric wiring member 102 is also fixed to the support member 103 using an adhesive. The recording element substrate 101 is exposed through the opening 104 of the electric wiring member 102.

Figure 3A:
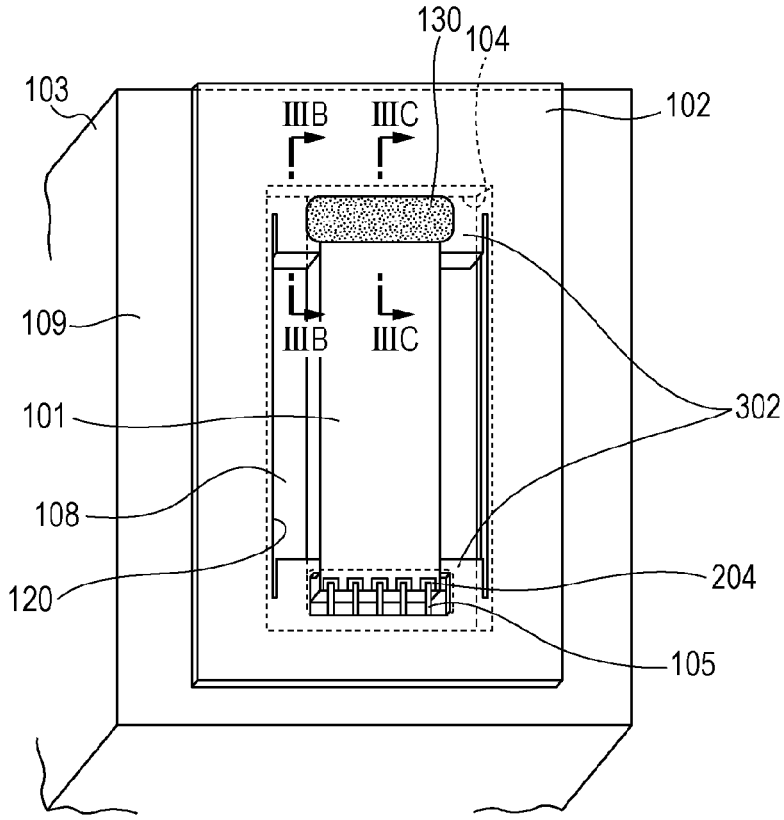
FIG. 3A is a schematic enlarged view of the recording element substrate according to the first embodiment and the vicinity thereof.
Figure 3B:
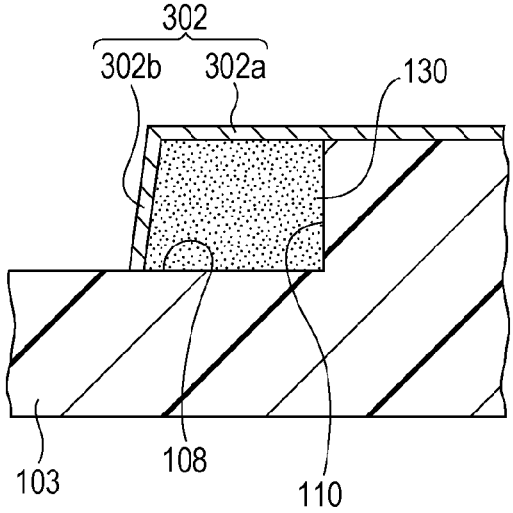
FIG. 3B is a sectional view taken along line IIIB-IIIB of FIG. 3A.
Figure 3C:
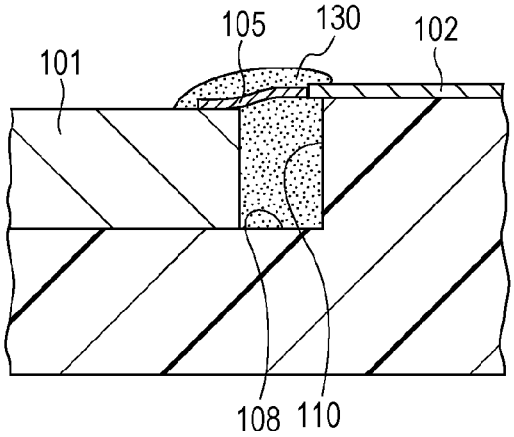
FIG. 3C is a sectional view taken along line IIIC-IIIC of FIG. 3A.

FIG. 3A is a schematic enlarged view of the recording element substrate 101 illustrated in FIG. 1A and the vicinity thereof. FIG. 3B is a sectional view taken along line IIIB-IIIB of FIG. 3A, and FIG. 3C is a sectional view taken along line IIIC-IIIC of FIG. 3A. As illustrated in FIGS. 3A to 3C, the recording element substrate 101 is disposed on the bottom surface of a recess 120 of the support member 103. To be specific, the recess 120 for placing the recording element substrate 101 therein is formed in a surface 109 of the support member 103, and the recording element substrate 101 is disposed on a bottom surface 108 of the recess 120. The electric wiring member 102 is bonded to a part of the surface 109 that surrounds the recess 120 using an adhesive. The recording element substrate 101, which is disposed in the recess 120, is exposed through the opening 104 of the electric wiring member 102. The reason for disposing the recording element substrate 101 on the bottom surface 108 of the recess 120 is as follows: because the bottom surface 108 is recessed from the surface 109 to which the electric wiring member 102 is bonded, the height of the electrode lead wires 105 becomes the same as that of the electrode pads 204 when the recording element substrate 101, and thereby the electrode lead wires 105 can be electrically connected to the electrode pads 204 with increased reliability. As is clear from FIGS. 3A to 3C, the inner surface of the recess 120 includes the bottom surface 108 and inner side surfaces 110 that extend substantially vertically from the sides of the bottom surface 108.

As illustrated in FIG. 3A, four protrusions 302 are formed at four corners of the opening 104 of the electric wiring member 102. In other words, the protrusions 302 extend from the sides (edges) of the opening 104 from which the electrode lead wires 105 extend. To be specific, two of the protrusions 302 extend from one of the short sides of the opening 104 toward the inside of the opening 104, and the other two protrusions 302 extend from the other short side of the opening 104 toward the inside of the opening 104. Each of the protrusions 302 extends in a gap between a side (long side) of the recording element substrate 101 along which the electrode pads 204 are not arranged and one of the inner side surfaces 110 of the recess 120 facing the long side. In other words, each of the protrusions 302 extends in a gap between a long side surface of the recording element substrate 101 and the inner side surface 110 of the recess 120 facing the long side surface.

As illustrated in FIG. 3B, each of the protrusions 302 includes a flat portion 302*a* and a bent portion 302*b*. The flat portion 302*a* extends along the plane of the opening 104. The bent portion 302*b* extends from an end of the flat portion 302*a* toward the bottom surface 108 of the recess 120 of the support member 103. The distal end of the protrusion 302 (the distal end of the bent portion 302*b*) is in contact with the bottom surface 108 of the recess 120.

As illustrated in FIGS. 3B and 3C, a space is surrounded by the back surface of the electric wiring member 102 including the back surface of the protrusion 302, a side surface of the recording element substrate 101, and an inner surface of the recess 120 of the support member 103; and the space is filled with the sealant 130, which is an example of a first sealant. The sealant 130 covers the front and back sides of the electrode lead wires 105, the electrode pads 204, and the joints therebetween, i.e., the electrical connection portion. As is clear from FIGS. 3B and 3C, the inner surface of the recess 120 that defines the aforementioned space includes part of the bottom surface 108 of the recess 120 and part of the inner side surfaces 110 of the recess 120. The protrusions 302 need not extend from the short sides of the opening 104. Instead, the protrusion 302 may extend from the long sides of the opening 104 or from a short side and a long side of the opening 104, as long as the protrusions 302 extend in the gaps between the side surface of the recording element substrate 101 and the inner side surface 110 of the recess 120 facing the side surface of the recording element substrate 101.

Next, a step of filling the space with the sealant 130, which is included in a method according to the present invention, will be described. First, the electrode lead wires 105 of the electric wiring member 102 are joined to the electrode pads 204 of the recording element substrate 101 by wire bonding. Subsequently, the recording element substrate 101 is aligned with the bottom surface 108 of the recess 120 of the support member 103, and the recording element substrate 101 is bonded to the bottom surface 108 of the recess 120 using an adhesive. Subsequently, the electric wiring member 102 is bonded to the surface 109 and to a side surface of the support member 103 adjacent to the surface 109 using an adhesive. A step of bending the electric wiring member 102 to form the bent portion 302*b* of the protrusion 302 may be performed before joining the recording element substrate 101 to the support member 103, simultaneously with joining the recording element substrate 101 to the support member 103, or after joining the recording element substrate 101 to the support member 103.

In any case, after joining the recording element substrate 101 and the electric wiring member 102 to the support member 103, the aforementioned space in the recess 120 is filled with the sealant 130 so as to cover the electrical connection portion. To be specific, the sealant 130 is poured through gaps between the electrode lead wires 105 into the space in the recess 120 of the support member 103, and the sealant 130 is supplied until the electrical connection portion is covered by the sealant 130 (see FIG. 3C). Therefore, a sealant having an appropriate viscosity is used as the sealant 130 so that the sealant can flow into the recess 120 of the support member 103 through the gaps between the electrode lead wires 105.

Subsequently, the sealant 130 is cured. To reinforce the joints between the electrode lead wires 105 and the electrode pads 204, a second sealant having a higher viscosity may be applied over a part of the sealant 130 covering the joints. Alternatively, a sealant the same as the sealant 130 may be applied over the part as a second sealant.

Figure 4A:
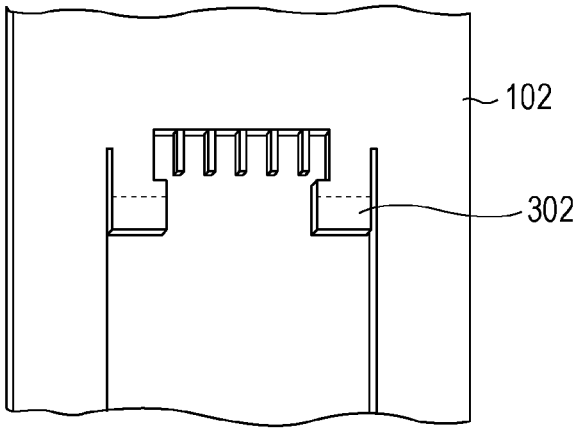
FIGS. 4A and 4B are schematic views of an electric wiring member according to the first embodiment.
Figure 4B:
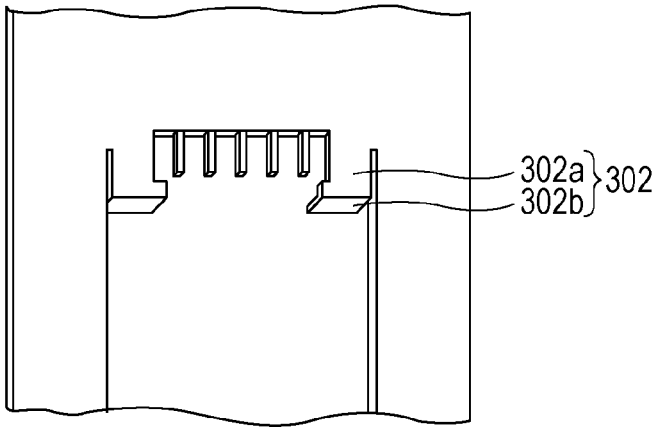
Figure 5A:
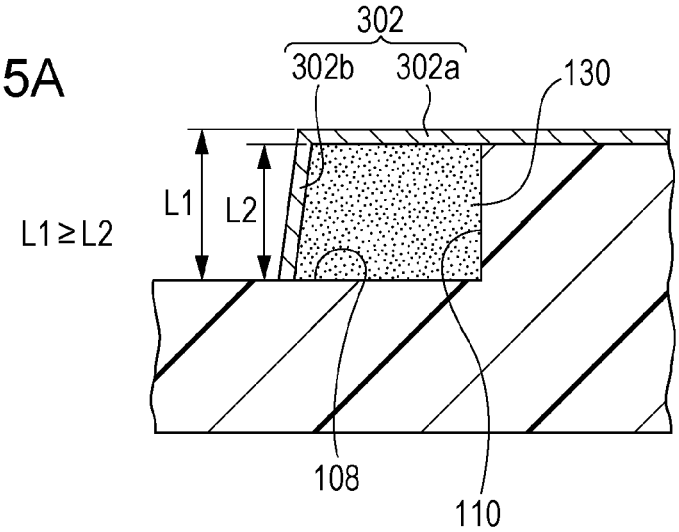
FIGS. 5A to 5C are schematic sectional views of a protrusion of the electric wiring member according to the first embodiment and the vicinity thereof.
Figure 5B:
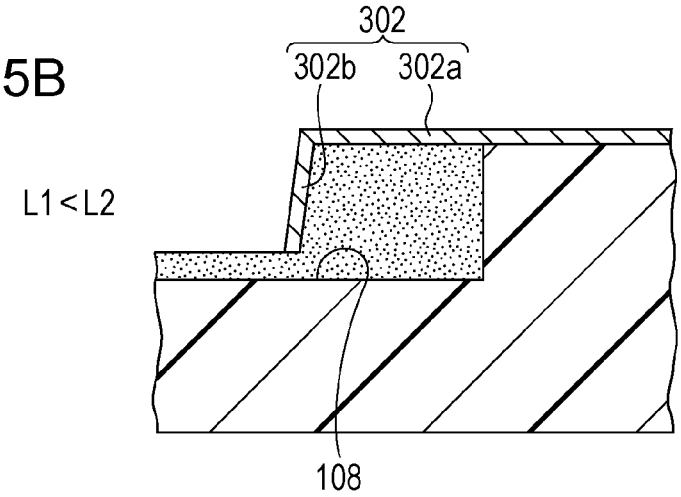

FIG. 4A is a schematic view of the protrusion 302 before the bent portion 302*b* is formed, and FIG. 4B is a schematic view of the protrusion 302 after the bent portion 302*b* has been formed. As illustrated in FIG. 5A, the protrusion 302 is bent such that a distal end portion thereof is in contact with the bottom surface 108 of the recess 120 of the support member 103. In this case, a relationship $L1 \geq L2$ exists, where L1 is the distance (length) from the position at which the protrusion 302 is bent (the boundary between the flat portion 302*a* and the bent portion 302*b*) to the distal end of the protrusion 302 (bent portion 302*b*), and L2 is the depth of the recess 120 of the support member 103. When this relationship exists, the gap between the distal end of the protrusion 302 and the bottom surface 108 of the recess 120 is very small, and thereby the sealant 130 is prevented from leaking through the gap to an area around the recording element substrate 101. In contrast, if a relationship $L1 < L2$ exists as illustrated in FIG. 5B, there is a large gap between the distal end of the protrusion 302 and the bottom surface 108 of the recess 120, and the sealant 130 leaks through the gap.

Figure 5C:
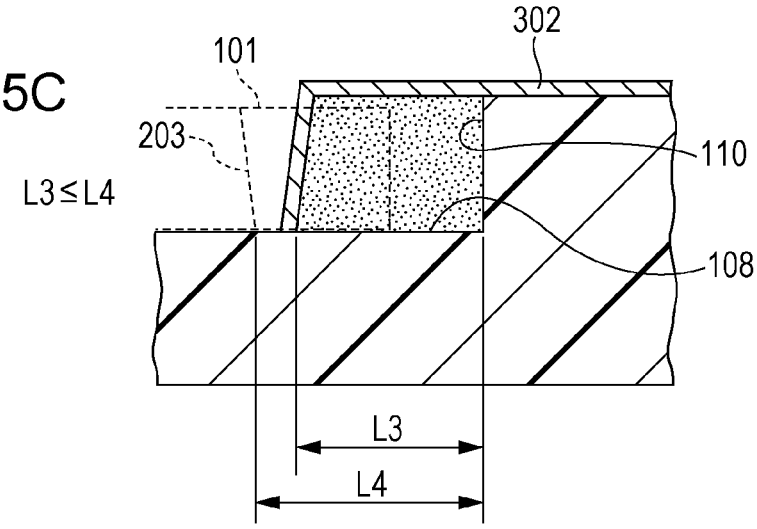

As illustrated in FIG. 5C, L3 denotes the distance from one of the inner side surfaces 110 of the recess 120 facing a side surface (an end surface in the longitudinal direction) of the recording element substrate 101 to a contact point between the distal end of the protrusion 302, which extends above the inner side surface 110 and the bottom surface 108 of the recess 120. L4 denotes the distance from the inner side surface 110 of the recess 120 to an edge of the liquid supply port 203 that is closest to the inner side surface 110. Here, the distance L3 and the distance L4 are linear distances along the bottom surface 108 of the recess 120. The shape and the size of the protrusion 302 are determined so that a relationship $L3 \leq L4$ exists. There are two reasons for this. The first reason is to prevent an unwanted external force, which is generated by expansion and contraction of the sealant 130, from acting on the recording element substrate 101. That is, a portion of the recording element substrate 101 in which the liquid supply port 203 is formed has a mechanical strength smaller than that of the other portions. Therefore, if the length L4 in FIG. 5C extends beyond an edge of the liquid supply port 203 of the recording element substrate 101, an unwanted external force generated by expansion and contraction of the sealant 130 may act on the recording element substrate 101. In this case, the probability of occurrence of ink discharge failure or mechanical breakage due to deformation of the recording element substrate 101 is as high as that of the case where the sealant is applied to the entire periphery of the recording element substrate 101. That is, the first reason is to reduce the influence of the unwanted external force. The second reason is to reduce the amount of the sealant used.

Figure 6A:
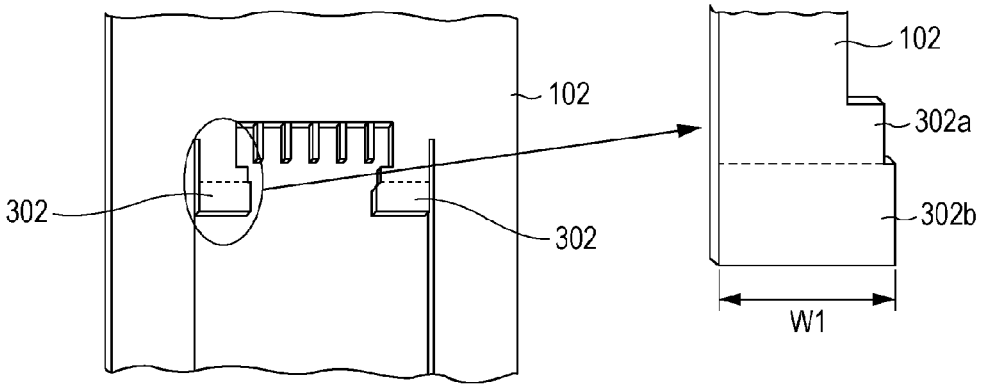
FIGS. 6A and 6B are schematic views of the protrusion of the electric wiring member according to the first embodiment.
Figure 6B:
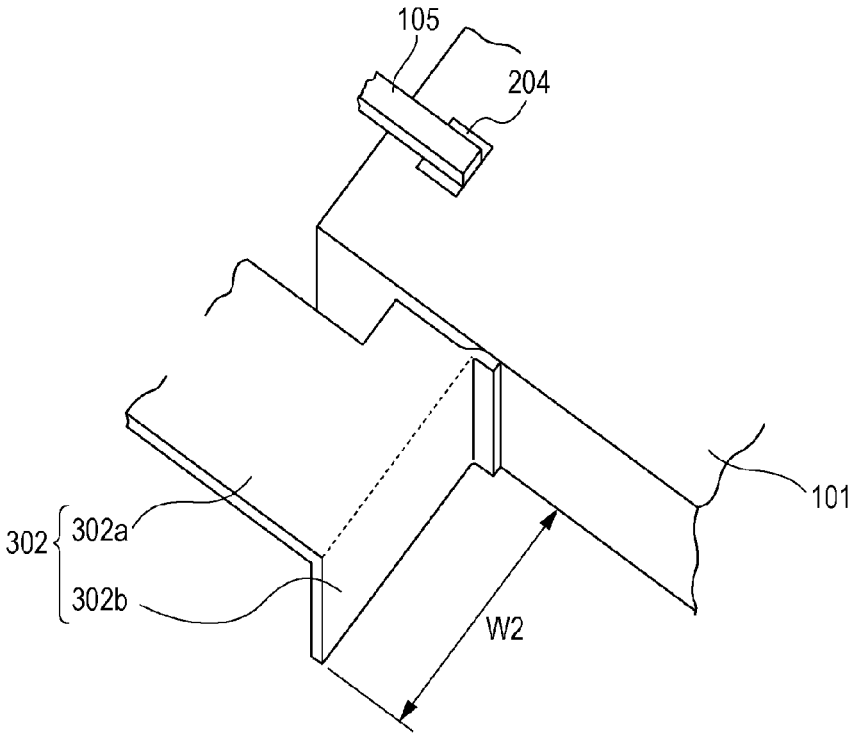

In addition, when the protrusion 302 has a shape illustrated in FIG. 6A, the sealant can be more reliably prevented from leaking. The protrusion 302 illustrated in FIG. 6A has a shape such that the width W1 of the bent portion 302*b* is slightly larger than the width W2 of a gap (FIG. 6B) between the side surface in the width direction (along a long side) of the recording element substrate 101 and the inner side surface (not shown) of the recess 120 facing the side surface. Therefore, as illustrated in FIG. 6B, a part of the bent portion 302*b* is brought into close contact with the side surface of the recording element substrate 101 in the width direction, and thereby leakage of the sealant is more reliably prevented.

The recording element substrate 101 and the electric wiring member 102 are joined to each other with reference to the positions of the electrode pads 204 and the electrode lead wires 105, and there are some allowances for these positions. However, even if there are allowances, the bent portion 302*b* can be reliably brought into contact with the side surface of the recording element substrate 101 in the width direction because the width W1 of the bent portion 302*b* is increased as described above, and thereby leakage of the sealant is more reliably prevented.

Second Embodiment

Figure 7A:
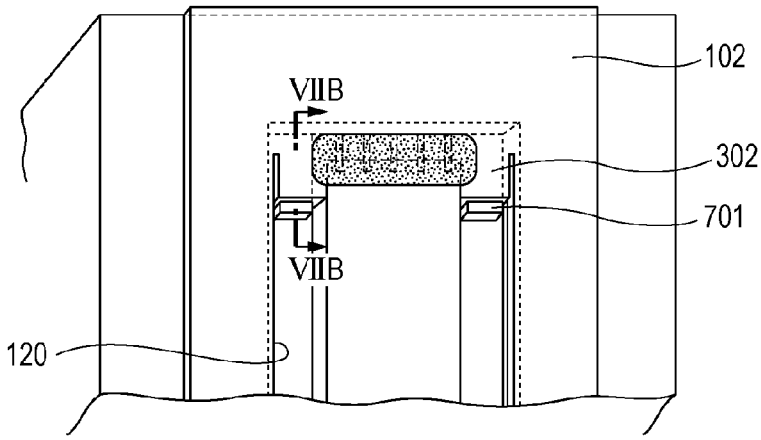
FIG. 7A is a schematic enlarged view of a recording element substrate according to a second embodiment and the vicinity thereof.
Figure 7B:
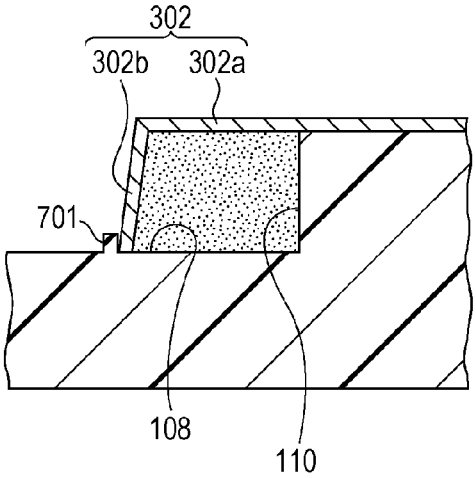
FIG. 7B is a sectional view taken along line VIIB-VIIB of FIG. 7A.
Figure 7C:
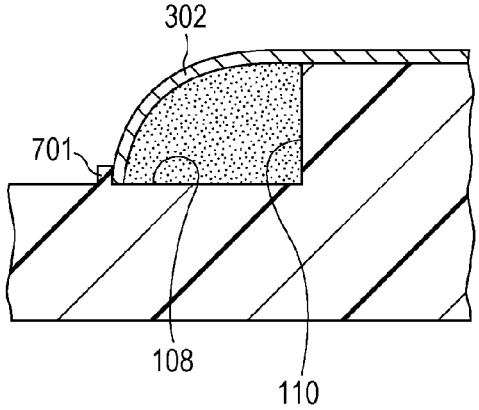
FIG. 7C illustrates a modification of the second embodiment.

Referring to FIGS. 7A to 7C, a second embodiment will be described. FIG. 7A is a schematic enlarged view of a recording element substrate of a liquid discharge head according to the second embodiment and the vicinity thereof. FIG. 7B is a sectional view taken along line VIIB-VIIB of FIG. 7A.

Four projections 701 are formed on the bottom surface 108 of the recess 120 of the support member 103 around the recording element substrate 101. Two of the grooves 701 are illustrated in FIG. 7A. To be specific, the projections 701 are disposed between side surfaces of the recording element substrate 101 in the width direction and the inner side surface of the recess 120 of the support member 103 facing the side surfaces. The distal end (of the bent portion 302*b*) of each of the protrusions 302 of the electric wiring member 102 abuts against and is engaged with a corresponding one of the projections 701. Therefore, even if the elasticity of the protrusions 302 is comparatively low, the sealant 130 can be reliably prevented from leaking from the back sides of the protrusions 302.

Because the projections 701 are formed simultaneously with molding the support member 103, the number of the components and the number of production steps do not increase. The shape of the projections 701 may be a rectangular parallelepiped as illustrated in FIGS. 7A to 7C, or may be any appropriate shape. The size of the projections 701 is not particularly limited as long as the width is smaller than the width W2 shown in FIG. 6B and the height is smaller than that of the recording element substrate 101.

The protrusions 302 need not be completely bent. Instead, as illustrated in FIG. 7C, the protrusions 302 may maintain its shape when the distal ends thereof are made to abut against the projections 701. In this case, a step of forming the bent portion 302*b* in the protrusion 302 may be omitted. A step of curving the protrusion 302 as illustrated in FIG. 7B may be performed simultaneously with a step of joining the recording element substrate 101 to the bottom surface 108 of the recess 120 of the support member 103 by using a jig.

Third Embodiment

Figure 8A:
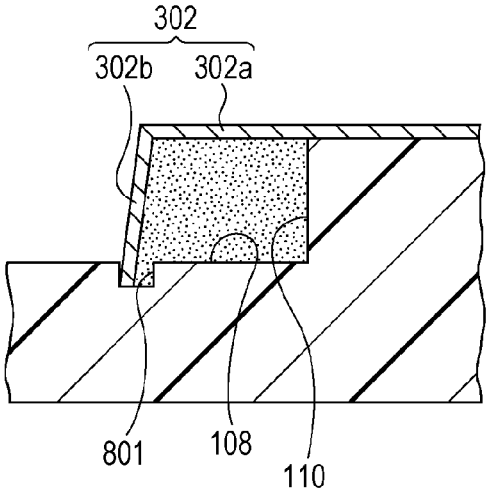
FIG. 8A is a schematic sectional view of a protrusion of a recording element substrate according to a third embodiment and the vicinity thereof.
Figure 8B:
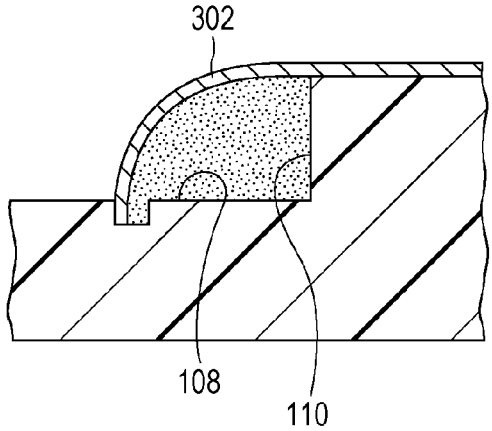
FIG. 8B is a schematic sectional view of a modification of the protrusion.
Figure 8C:
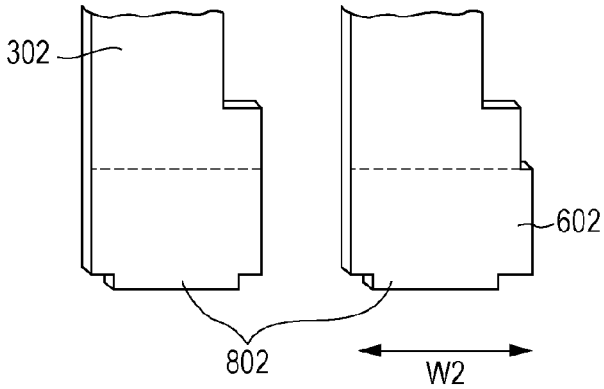
FIG. 8C is a schematic view of the protrusion.

Referring to FIGS. 8A to 8C, a third embodiment will be described. FIG. 8A is a schematic sectional view of a protrusion of a recording element substrate according to the third embodiment and the vicinity thereof.

Four grooves 801 are formed in the bottom surface 108 of the recess 120 of the support member 103 around the recording element substrate 101. One of the grooves 801 is illustrated in FIG. 8A. To be specific, the grooves 801 are disposed between side surfaces of the recording element substrate 101 in the width direction and inner side surfaces of the recess 120 of the support member 103 facing the side surfaces. The distal end of each of the protrusions 302 of the electric wiring member 102 is fitted into and engaged with a corresponding one of the grooves 801. Therefore, even if the elasticity of the protrusions 302 is comparatively low, the sealant 130 can be reliably prevented from leaking from the back sides of the protrusions 302. Because the grooves 801 are formed simultaneously with molding the support member 103, the number of the components and the number of production steps do not increase.

In the third embodiment, a tab portion 802 is formed at the distal end of the protrusion 302 as illustrated in FIG. 8C so that the distal end of the protrusion 302 can be reliably inserted into the groove 801. The shape of the grooves 801 is not limited to the shape illustrated in FIGS. 8A and 8B and may be any appropriate shape. The size of the grooves 801 is not particularly limited as long as its width is smaller than the width W2 in FIG. 6B.

Also in the third embodiment, the width W1 of the protrusion 302 may be slightly larger than the width W2 in FIG. 6B.

The protrusions 302 need not be completely bent. Instead, as illustrated in FIG. 8B, the protrusions 302 may be configured to maintain its shape when the distal ends thereof are fit into the grooves 801. In this case, a step of forming the bent portion 302*b* in the protrusion 302 may be omitted. The step of curving the protrusion 302 as illustrated in FIG. 8B may be performed simultaneously with a step of joining the recording element substrate 101 to the support member 103 by using a jig.

A liquid discharge head according to the invention can be used in a general printer, a copier, a facsimile having a communication unit, a word processor having a printer, or a multifunction device having the functions of these devices.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-148187 filed Jul. 4, 2011, which is hereby incorporated by reference herein in its entirety.

What is claimed is:

1. A liquid discharge head comprising:

a recording element substrate including an electrode pad for sending a signal to an element that generates energy used to discharge liquid;

a support member including a recess that supports the recording element substrate on a bottom surface thereof;

an electric wiring member joined to a surface of the support member in which the recess is formed, the electric wiring member including an opening through which the recording element substrate is exposed, an electric lead wire extending from the opening and connected to the electrode pad, and a protrusion that is integral with the electric wiring member and formed in the opening and extending between a side surface of the recording element substrate and an inner side surface of the recess facing the side surface, wherein a distal end of the protrusion contacts the bottom surface of the recess when the protrusion is accordingly deformed; and a sealant disposed in a region surrounded by a surface of the protrusion, the bottom surface of the recess, the inner side surface of the recess, and the side surface of the recording element substrate.

2. The liquid discharge head according to claim 1, wherein a projection is formed on the bottom surface of the recess and the distal end of the protrusion engaging the projection.

3. The liquid discharge head according to claim 1, wherein a groove is formed in the bottom surface of the recess and the distal end of the protrusion engaging the groove.

4. The liquid discharge head according to claim 1, wherein the protrusion includes a flat portion extending along a plane of the opening and a bent portion bent to extend from the flat portion toward the bottom surface of the recess and contacting the bottom surface of the recess.

5. The liquid discharge head according to claim 4, wherein a relationship $L1 \geq L2$ exists, where L1 is a length from a boundary between the flat portion and the bent portion to the distal end of the protrusion and L2 is a depth of the recess.

6. The liquid discharge head according to claim 1, wherein a part of the protrusion contacts the side surface of the recording element substrate.

7. The liquid discharge head according to claim 1, wherein a part of the protrusion contacts the inner side surface of the recess.

8. The liquid discharge head according to claim 1, wherein a second sealant is superposed on the sealant.

9. The liquid discharge head according to claim 8, wherein the sealant and the second sealant are the same sealant.

10. The liquid discharge head according to claim 8, wherein a viscosity of the second sealant is greater than a viscosity of the sealant.

11. The liquid discharge head according to claim 1, wherein a liquid supply port extends through the recording element substrate, and wherein a relationship $L4 \geq L3$ exists, where L3 is a distance extending along the bottom surface of the recess from an inner side surface of the recess facing a side surface of the recording element substrate along which the electrode pad is formed to the distal end of the protrusion, and L4 is a distance extending along the bottom surface of the recess from the inner side surface of the recess facing the side surface of the recording element substrate along which the electrode pad is formed to an edge of the liquid supply port closest to the inner side surface.

* * * * *